US008771399B2

(12) United States Patent
Bieniosek

(10) Patent No.: US 8,771,399 B2
(45) Date of Patent: Jul. 8, 2014

(54) DESULFURIZATION PUCK

(75) Inventor: Thomas H. Bieniosek, Litchfield, OH (US)

(73) Assignee: Magnesium Technologies Corporation, Independence, OH (US)

( * ) Notice: Subject to any disclaimer, the term of this patent is extended or adjusted under 35 U.S.C. 154(b) by 714 days.

(21) Appl. No.: 12/720,931

(22) Filed: Mar. 10, 2010

(65) Prior Publication Data

US 2010/0162853 A1 Jul. 1, 2010

Related U.S. Application Data

(63) Continuation of application No. 11/707,447, filed on Feb. 16, 2007.

(51) Int. Cl.

| | |
|---|---|
| ***C21C 5/04*** | (2006.01) |
| ***B22F 9/00*** | (2006.01) |
| ***C21B 11/10*** | (2006.01) |
| ***C22B 5/20*** | (2006.01) |
| ***C21B 13/00*** | (2006.01) |
| ***C22B 9/00*** | (2006.01) |
| ***C21B 7/14*** | (2006.01) |
| ***F27D 27/00*** | (2010.01) |
| ***B22D 11/10*** | (2006.01) |

(52) U.S. Cl.
USPC ..... 75/526; 75/336; 75/392; 75/414; 75/433; 75/507; 75/581; 75/582; 75/583; 75/584

(58) Field of Classification Search
None
See application file for complete search history.

(56) References Cited

U.S. PATENT DOCUMENTS

| | | | | |
|---|---|---|---|---|
| 3,681,048 | A * | 8/1972 | Otani | 75/572 |
| 4,173,466 | A * | 11/1979 | McLaughlin et al. | 75/315 |
| 6,989,040 | B2 * | 1/2006 | Zebrowski | 75/315 |

FOREIGN PATENT DOCUMENTS

| | | | | |
|---|---|---|---|---|
| JP | 2001-032007 | * | 2/2001 | C21C 5/28 |

OTHER PUBLICATIONS

Kanamori et al, Kanamori et al (2001).*

* cited by examiner

*Primary Examiner* — Yoshitoshi Takeuchi
(74) *Attorney, Agent, or Firm* — Fay Sharpe LLP

(57) ABSTRACT

A method and composition for removing sulfur from molten ferrous material, particularly molten iron. The desulfurization agent includes one or more pucks or briquettes of deoxidizing and/or desulfurization agent. The pucks or briquettes of deoxidizing and/or desulfurization agent include at least one deoxidizing metal and at least one ferrous metal.

16 Claims, No Drawings

DESULFURIZATION PUCK

The present invention is a continuation of U.S. patent application Ser. No. 11,707,447 filed Feb. 16, 2007.

The present invention relates to a method of desulfurization of molten iron, and more particularly to a desulfurization agent that includes a deoxidizing agent to desulfurize molten iron, and even more particularly to a desulfurization agent that includes reclaimed magnesium and iron scrap that is formed into a briquette or puck to desulfurize molten iron.

INCORPORATION BY REFERENCE

U.S. Pat. Nos. 3,598,573; 3,876,421; 3,929,464; 3,998,625; 4,078,915; 4,137,072; 4,139,369; 4,194,902; 4,266,969; 4,315,773; 4,345,940; 4,395,282; 4,592,777; 4,705,561; 4,708,737; 4,764,211; 4,765,830; 4,832,739; 5,021,086; 6,352,570; 6,372,014; 6,989,040, and Luxemburg Patent No. 88,252 are incorporated in their entirety herein by reference as examples of desulfurization agents that could incorporate the use of the reclaimed magnesium of the present invention.

BACKGROUND OF THE INVENTION

The sulfur content in iron ores and other materials, commonly used in pig-iron production, i.e., coal and coke, have increased the costs of steel making. As a result, it is becoming increasingly desirable to desulfurize the pig-iron before the iron enters the basic oxygen furnace and/or steel making furnace. In addition, specifications for the sulfur content of finished steel are decreasing to extremely low levels to make high strength low alloy steel, and steels resistant to hydrogen induced cracking, among other applications requiring low sulfur contents. In combination with the economic benefits of blast furnace operations producing molten pig-iron with increased sulfur contents, the desulfurization of molten pig-iron external to the blast furnace before the molten pig-iron enters the steel making furnace has become a practical necessity.

Over the years, a wide variety of materials and mixtures have been used to desulfurize pig-iron. It has long been known that various calcium compounds are good desulfurization agents. It has also been known that magnesium, alone or in combination with various alkaline metal oxides, is also a good desulfurization agent. There have been several patents which disclose the use of calcium oxide and magnesium as the primary desulfurization agents. (See Skach U.S. Pat. No. 4,765,830; Skach U.S. Pat. No. 4,708,737; Green U.S. Pat. No. 4,705,561; Kandler U.S. Pat. No. 4,139,369; Kawakami U.S. Pat. No. 4,137,072; Koros U.S. Pat. No. 3,998,625.) Furthermore, desulfurization agents disclosing the use of calcium carbide as the primary desulfurization agent have also been known and well documented. (See Freissmuth U.S. Pat. No. 3,598,573; Todd U.S. Pat. No. 3,929,464; Braun U.S. Pat. No. 4,395,282).

Many of the desulfurization agents described in the above listed patents remove the desired amount of sulfur and other impurities from molten iron. However, in an industry constantly driven by margins, there remains a need for a more cost effective desulfurization agent. The magnesium component of the desulfurization agent is typically the highest-cost component. Domestically refined primary magnesium powder can cost over to $1.80/lb. As a result, there has been some interest in using magnesium scrap. Magnesium scrap is available from rejected and/or process scrap in the form of machined chips which are common in the automobile and electronics industry. Magnesium metal is commonly machined using mineral oil and oil/water emulsions resulting in waste magnesium chips and cutting fluid. The cutting fluid can constitute up to 35-50 weight percent of the waste material. The magnesium chip/cutting fluid mixture typically cannot be disposed of due to the reactivity of magnesium with water. The large volume of cutting fluid in the magnesium chip/cutting fluid mixture increases the transportation costs of the mixture. Due to the transport costs and/or processing problems of the magnesium chip/cutting fluid mixture, the mixture is commonly burned instead of being reclaimed.

Some progress has been made concerning the recovery of magnesium from a magnesium chip/cutting fluid mixture. Several of these processes are disclosed in U.S. Pat. Nos. 2,299,043; 2,358,667; 3,656,735; 3,767,179; and 5,338,335, all of which are incorporated herein. In these processes, the water and oil in the magnesium chip/cutting fluid mixture is burnt off in a rotary kiln. The substantially oil free magnesium chips are then remelted and formed and/or extruded into a final product. Solvents may be used to separate a portion of the cutting fluid from the magnesium chips prior to drying the magnesium chips. Although these processes are successful in reclaiming magnesium, the energy costs associated with the heating of the magnesium chip/cutting fluid mixture have not resulted in a cost-effective process. Combustion problems remain with the drying of the magnesium chips resulting in higher recovery costs. In addition, the oxidation of the magnesium during the drying process accounts for a significant loss of magnesium being reclaimed. Additional losses are encountered when using a solvent prior to drying.

Another process for reclaiming magnesium from a magnesium chip/cutting fluid mixture is by pressing the mixture together to form a magnesium puck or briquette. This process can reduce the cutting fluid content of puck or briquette to about 7%. The squeezed out cutting fluid can be recycled and the transport costs of the magnesium in the form of a puck or briquette are significantly reduced. In addition, due to the low cutting fluid content of the puck or briquette, the puck or briquette can be more safely transported in such form. Furthermore, the compression process is less costly than processing utilizing a heated rotary kiln. One such process for forming a magnesium puck is disclosed in U.S. Pat. No. 6,989,040, which is incorporated herein.

In view of the present state of technology, there continues a need for a lower cost and effective desulfurization agent that can utilize reclaimed material.

SUMMARY OF THE INVENTION

The present invention relates to an improved deoxidizing and/or desulfurization agent and method of deoxidizing and desulfurization of molten ferrous materials such as, but not limited to, molten pig-iron, ferro-silicon alloy, etc., wherein the deoxidizing and/or desulfurization agent includes one or more metal deoxidizers (e.g., reclaimed aluminum, reclaimed magnesium, reclaimed titanium, reclaimed zirconium, etc.) in combination with a ferrous material (e.g., carbon steel, stainless steel, etc.). Typically, the deoxidizing and/or desulfurization agent is a solid material at least at ambient temperature (i.e., 70° F.); however, this is not required. The deoxidizing and/or desulfurization agent is formulated to at least partially react with and/or at least partially remove oxygen and/or sulfur from molten iron. The deoxidizing and/or desulfurization agent is further selected to minimize the introduction of undesired elements, such as sulfur, into the molten iron during the desulfurization process. In one non-limiting embodiment of the invention, the deoxidizing and/or desulfurization agent includes at least one metal deoxidizer and at least one ferrous material that have been compressed together to form a puck or briquette. In one non-limiting aspect of the present invention the at least one metal deoxidizer and at least one ferrous material have been compressed together to form a puck or briquette having an average density that is sufficient to inhibit or prevent a majority of the pucks or briquettes from floating to the surface of the molten ferrous material when molten ferrous material is poured onto the pucks or briquettes. When the density of the pucks or briquettes is not great enough, the pucks or briquettes can float to the surface of the molten ferrous material, thereby reducing the effectiveness of the deoxidizing and/or desulfurization agent. Depending on the particular composition of the molten iron and the temperature of the molten iron, the density of the molten iron may vary somewhat. Generally the density of molten iron is about 6.8-7.0 g/cm$^3$. In one non-limiting example, the at least one metal deoxidizer and at least one ferrous material are compressed together to at least partially form a puck or briquette of deoxidizing and/or desulfurization agent having an average density of at least about 6.8 g/cm$^3$ (430 lbs./ft$^3$). In another non-limiting example, the at least one metal deoxidizer and at least one ferrous material are compressed together to at least partially form a puck or briquette of deoxidizing and/or desulfurization agent having an average density of at least about 7 g/cm$^3$. In still another non-limiting example, the at least one metal deoxidizer and at least one ferrous material are compressed together to at least partially form a puck or briquette of deoxidizing and/or desulfurization agent having an average density of about 7-7.8 g/cm$^3$. In yet another non-limiting example, the at least one metal deoxidizer and at least one ferrous material are compressed together to at least partially form a puck or briquette of deoxidizing and/or desulfurization agent having an average density of about 7.05-7.6 g/cm$^3$. In another and/or alternative non-limiting embodiment of the invention, the weight ratio of ferrous material to metal deoxidizer in the puck or briquette of deoxidizing and/or desulfurization agent is at least about 2:1. In one non-limiting example, the weight ratio of ferrous material to metal deoxidizer in the puck or briquette of deoxidizing and/or desulfurization agent is at least about 4:1. In another non-limiting example, the weight ratio of ferrous material to metal deoxidizer in the puck or briquette of deoxidizing and/or desulfurization agent is at least about 5:1. In still another non-limiting example, the weight ratio of ferrous material to metal deoxidizer in the puck or briquette of deoxidizing and/or desulfurization agent is about 5-200:1. In yet another non-limiting example, the weight ratio of ferrous material to metal deoxidizer in the puck or briquette of deoxidizing and/or desulfurization agent is about 6-100:1. In still yet another non-limiting example, the weight ratio of ferrous material to metal deoxidizer in the puck or briquette of deoxidizing and/or desulfurization agent is about 6-20:1. As can be appreciated, other weight ratios can be used. In still another and/or alternative non-limiting embodiment of the invention, the puck or briquette of deoxidizing and/or desulfurization agent includes at least about 0.1 weight percent of at least one metal deoxidizer and at least about 50 weight percent at least one ferrous material. In one non-limiting example, the puck or briquette of deoxidizing and/or desulfurization agent includes at least about 0.5 weight percent of at least one metal deoxidizer and at least about 70 weight percent at least one ferrous material. In another non-limiting example, the puck or briquette of deoxidizing and/or desulfurization agent includes at least about 1 weight percent of at least one metal deoxidizer and at least about 80 weight percent at least one ferrous material. In still another non-limiting example, the puck or briquette of deoxidizing and/or desulfurization agent includes at least about 2 weight percent of at least one metal deoxidizer and at least about 82 weight percent at least one ferrous material. In still another non-limiting example, the puck or briquette of deoxidizing and/or desulfurization agent includes at least about 5 weight percent of at least one metal deoxidizer and at least about 85 weight percent at least one ferrous material.

In another and/or alternative aspect of the present invention, the source of the at least one metal deoxidizer and/or the at least one ferrous material can be at partially from metal scrap. In one embodiment of the present invention, a majority of the metal deoxidizer that is included in the puck or briquette of deoxidizing and/or desulfurization agent is from reclaimed metal scrap. The metal scrap can be derived form a variety of sources. One common source is the automotive industry where many automotive components such as motors, gear boxes, steering wheel, etc. are made of or include magnesium; however, many other industries also generate magnesium scrap that can be used in the present invention. As can be appreciated, other or additional metal deoxidizers can be obtained from similar sources. In addition, the source of ferrous material may also be fully or in partially from ferrous metal scrap. In another and/or additional non-limiting embodiment of the present invention, a majority of the ferrous material that is included in the puck or briquette of deoxidizing and/or desulfurization agent is from reclaimed metal scrap. The scrap of deoxidizer material and/or ferrous metal, when used, can be mixed with oil and/or water. The oil and/or water functions as a lubricant during the shaping and/or cutting of the deoxidizer material and/or ferrous metal during the formation of various components. The amount of oil and/or water in the puck or briquette of deoxidizing and/or desulfurization agent is generally less than about 10 weight percent of the puck or briquette. In one non-limiting example, the amount of oil and/or water in the puck or briquette of deoxidizing and/or desulfurization agent is less than about 5 weight percent of the puck or briquette. In another non-limiting example, the amount of oil and/or water in the puck or briquette of deoxidizing and/or desulfurization agent is less than about 4 weight percent of the puck or briquette. In still another non-limiting example, the amount of oil and/or water in the puck or briquette of deoxidizing and/or desulfurization agent is less than about 2 weight percent of the puck or briquette. As can be appreciated, the puck or briquette of deoxidizing and/or desulfurization agent can have essentially no oil and/or water. The fluid content of the puck or briquette can function as a gas-producing compound of the deoxidizing and/or desulfurization agent; however, this is not required. The water and/or oil in the puck or briquette vaporizes when in contact with the molten iron. The vaporized water and/or oil can result in at least partially mixing various components of the desulfurization agent throughout the molten iron to facilitate in enhancing the reaction between the various deoxidizing and/or desulfurization agent and/or other components in the molten iron; however, this is not required.

In still another and/or alternative aspect of the present invention, the puck or briquette of deoxidizing and/or desulfurization agent can be formed by a briquetting process. One non-limiting briquetting process is disclosed by Altek International and/or EMI. The briquetting process can include the use of a device that compresses deoxidizer material and/or ferrous metal chips, turnings and the like that may or may not include oil and/or water into pucks or briquettes. In addition to the use of a press to form the puck or briquette of deoxidizing and/or desulfurization agent, some of the fluid that may be included with the deoxidizer material and/or ferrous metal chips, turnings and the like can be at least partially removed from the deoxidizer material and/or ferrous metal chips, turnings and the like by cycloning the mixture. As can be appreciated, the use of a cyclone is not required. In addition and/or alternatively, the deoxidizer material and/or ferrous metal chips, turnings and the like can be heated and/or treated with solvents to at least partially separate the fluid from the deoxidizer material and/or ferrous metal chips, turnings and the like; however, this is not required. The pucks or briquettes can have a variety of shapes and sizes. One non-limiting shape and size of a puck or briquette of deoxidizing and/or desulfurization agent is a cylindrically shaped briquette having a radius of about 1-10 inches and a height of about 1-6 inches; however, other sizes and shapes (e.g., spherical, bar-shaped, etc.) can be formed. The briquetting process can be used to reduce the oil and/or water content of the deoxidizer material and/or ferrous metal chips, turnings and the like; however, this is not required.

In yet another and/or alternative aspect of the present invention, the puck or briquette of deoxidizing and/or desulfurization agent can include a calcium compound; however, this is not required. When a calcium compound is included in the puck or briquette of deoxidizing and/or desulfurization agent, the calcium compound is generally selected to react with sulfur in the molten iron. The calcium compound can be a single calcium compound or a combination of two or more calcium compounds. In one non-limiting embodiment of the invention, various calcium compounds can be used such as, but not limited to, calcium carbide, calcium carbonate, calcium chloride, calcium cyanamide, calcium iodide, calcium nitrate and/or calcium nitrite. In one non-limiting formulation, the calcium compound primarily includes calcium oxide, calcium carbonate, and/or calcium carbide. In another and/or alternative non-limiting formulation, the calcium compound is primarily calcium oxide. In another and/or alternative aspect of this embodiment, the calcium compound, when used, constitutes less than about at least about 20 weight percent of the desulfurization agent. In one non-limiting formulation, the calcium compound, when used, constitutes at least about 10 weight percent of the desulfurization agent. In another and/or alternative non-limiting formulation, the calcium compound, when used, constitutes about 0.5-10 weight percent of the desulfurization agent.

In still yet another and/or alternative aspect of the present invention, the metal deoxidizer that is included in the puck or briquette of deoxidizing and/or desulfurization agent includes magnesium. In one non-limiting embodiment of the present invention, the magnesium can include pure magnesium, a magnesium alloy and/or a magnesium compound. In another and/or alternative non-limiting embodiment of the present invention, magnesium constitutes at least about 5 weight percent of the metal deoxidizer in the puck or briquette of deoxidizing and/or desulfurization agent. In one non-limiting aspect of this embodiment, the magnesium constitutes at least about 10 weight percent of the metal deoxidizer in the puck or briquette of deoxidizing and/or desulfurization agent. In still another non-limiting aspect of this embodiment, the magnesium constitutes at least about 30 weight percent of the metal deoxidizer in the puck or briquette of deoxidizing and/or desulfurization agent. In yet another non-limiting aspect of this embodiment, the magnesium constitutes at least a majority weight percent of the metal deoxidizer in the puck or briquette of deoxidizing and/or desulfurization agent. In still yet another non-limiting aspect of this embodiment, the magnesium constitutes at least about 75 weight percent of the metal deoxidizer in the puck or briquette of deoxidizing and/or desulfurization agent. In another non-limiting aspect of this embodiment, the magnesium constitutes essentially all of the metal deoxidizer in the puck or briquette of deoxidizing and/or desulfurization agent. In still another and/or alternative non-limiting embodiment of the present invention, magnesium and at least one other metal deoxidizer are included in the puck or briquette of deoxidizing and/or desulfurization agent. As indicated above, the magnesium metal can constitute various weight percentages of the metal deoxidizer in the puck or briquette of deoxidizing and/or desulfurization agent and one or more other metal deoxidizer for the balance of the metal deoxidizer in the puck or briquette of deoxidizing and/or desulfurization agent.

In another and/or alternative aspect of the present invention, puck or briquette of deoxidizing and/or desulfurization agent can include one or more gas-producing compounds; however, this is not required. The gas-producing compound, when used, forms a gas upon contact with molten iron. The produced gas can be used to at least partially mixes the various components of the desulfurization agent throughout the iron to facilitate in enhancing the reaction between the various desulfurization agents and the sulfur in the molten iron; however, this is not required. In one non-limiting embodiment of the present invention, the gas-producing compound can include water, hydrocarbons, alcohols, and/or carbonates. In one non-limiting aspect of this embodiment, the gas-producing compound can be a liquid and/or a solid material. In another non-limiting aspect of this embodiment, the gas-producing material can include a solid compound such as, but not limited to, coal, plastic, rubber, solid hydrocarbons, solid alcohols, solid nitrogen containing compounds, solid esters and/or solid ethers. In still another and/or alternative non-limiting aspect of this embodiment, the gas-producing material includes a liquid compound such as, but not limited to, liquid hydrocarbons. In still another and/or alternative embodiment of the invention, the gas-producing compound, when used, constitutes less than about 10 weight percent of the puck or briquette of deoxidizing and/or desulfurization agent. In one non-limiting aspect of this embodiment, the gas-producing compound constitutes less than about 5 weight percent of the puck or briquette of deoxidizing and/or desulfurization agent. In another non-limiting aspect of this embodiment, the gas-producing compound constitutes less than about 2 weight percent of the puck or briquette of deoxidizing and/or desulfurization agent.

In still another and/or alternative aspect of the present invention, the puck or briquette of deoxidizing and/or desulfurization agent can be use as a whole during the deoxidizing and desulfurization of the molten iron.

In yet another and/or alternative aspect of the present invention, a calcium compound can be added in conjunction with one or more the pucks or briquettes of deoxidizing and/or desulfurization agent to the molten iron to deoxidizing and desulfurization the molten iron; however, this is not required. The calcium compound, when added with one or more the pucks or briquettes of deoxidizing and/or desulfurization agent, has an average particle size of less than about 12 U.S. Standard Mesh, typically about 14 to about 500 U.S. Standard Mesh, more typically about 14 to about 325 U.S. Standard Mesh, still more typically less than about 14 U.S. Standard Mesh, yet even more typically about 16 to about 200 U.S. Standard Mesh, even more typically about 16 to about 100 U.S. Standard Mesh, still even more typically less than about 14 U.S. Standard Mesh, and still yet even more typically about 18 to about 100 U.S. Standard Mesh.

In still yet another and/or alternative aspect of the present invention, the pucks or briquettes of deoxidizing and/or desulfurization agent can be first placed in an iron trough or ladle and molten iron can be poured onto the top of the pucks or briquettes of deoxidizing and/or desulfurization agent. As can be appreciated, one or more pucks or briquettes of deoxidizing and/or desulfurization agent can be added to the molten ion during and/or after the addition of the molten iron to the iron trough or ladle. The molten iron can be stirred and/or agitated in the iron tough during use of the one or more pucks or briquettes of deoxidizing and/or desulfurization agent; however, this is not required. The stirring of the molten iron can be accomplished by use of mechanical stirrer and/or by gas stirring. The agitation of the molten iron can be accomplished by the injection of one or more reagents (e.g., calcium compound, magnesium particles, etc.) into the molten iron by use of one or more lances. As can be appreciated, the molten iron can be stirred and/or agitated in other or additional ways. Typically the slag that forms on the top surface of the molten iron in the iron trough is removed during the deoxidizing and desulfurization process. The molten iron can be further processed with one or more pucks or briquettes of deoxidizing and/or desulfurization agent by adding one or more pucks or briquettes of deoxidizing and/or desulfurization agent to the molten iron; however, this is not required. The molten iron can be further processed by the additional of other desulfurization agents to the molten iron. For example, another type of desulfurization agent can be injected into molten iron by a lance after the molten iron was first processed by use of one or more pucks or briquettes of deoxidizing and/or desulfurization agent. For example, a desulfurization agent that includes particles of a calcium compound and/or magnesium particles can be injected into the molten iron. Non-limiting examples of such desulfurization agents are disclosed in the patent identified above which are incorporated herein by reference.

In summary, the present invention is directed to a desulfurization agent for removing oxygen and/or sulfur from molten iron. The desulfurization agent includes at least one ferrous material and at least one deoxidizing metal that are formed into a puck or briquette. The puck or briquette has an average density of at least about 6.9 g/cm$^3$. In another non-limiting embodiment of the invention, the ferrous material includes carbon steel, stainless steel, or mixtures thereof, and the deoxidizing metal includes aluminum, magnesium, titanium, zirconium, or mixtures thereof. In another non-limiting embodiment of the invention, a total weight percent of the ferrous material is greater than a total weight percent of the deoxidizing metal in the puck or briquette. In another non-limiting embodiment of the invention, the deoxidizing metal includes reclaimed deoxidizing metal. In another non-limiting embodiment of the invention, the ferrous metal includes reclaimed ferrous metal. In another non-limiting embodiment of the invention, the desulfurization agent includes a liquid, and the liquid content of the puck or briquette is about 0.001-5 weight percent. In another non-limiting embodiment of the invention, the liquid includes water, hydrocarbon compound, or mixtures thereof. In another non-limiting embodiment of the invention, the desulfurization agent includes a calcium compound, and the calcium compound content of the puck or briquette is about 0.1-20 weight percent. In another non-limiting embodiment of the invention, there is provided a method for forming a deoxidizing and/or desulfurization agent comprising the steps of a) selecting at least one ferrous material, b) selecting at least one deoxidizing metal, and c) compressing said at least one ferrous material and at least one deoxidizing metal into a puck or briquette having a density of at least about 6.9 g/cm$^3$. In another non-limiting embodiment of the invention, there is provided a method for deoxidizing and/or desulfurizing molten iron which comprises adding to the molten iron a desulfurization agent, and the desulfurization agent includes at least one ferrous material and at least one deoxidizing metal formed into a puck or briquette and the puck or briquette has an average density of at least about 6.9 g/cm$^3$.

One non-limiting object of the present invention is the provision of a desulfurization agent that increases the efficiency of desulfurization of iron.

Another and/or alternative non-limiting object of the present invention is the provision of a deoxidizing and/or desulfurization agent that includes reclaimed deoxidizing metal.

Still another and/or alternative non-limiting object of the present invention is the provision of a deoxidizing and/or desulfurization agent that is in the form of a puck or briquette of deoxidizing and/or desulfurization agent.

Yet another and/or alternative non-limiting object of the present invention is the provision of a deoxidizing and/or desulfurization agent that has an average density that is equal to or greater than the density of the molten metal that is to be desulfurize and/or deoxidized by the desulfurization agent.

Still yet another and/or alternative non-limiting object of the present invention is the provision of a deoxidizing and/or desulfurization agent that includes one or more deoxidizing metals and one or more ferrous metal that are compressed into puck or briquette of deoxidizing and/or desulfurization agent.

These and other objects of the invention will become apparent to those skilled in the art upon reading and understanding the following detailed description of the non-limiting embodiments of the invention.

DESCRIPTION OF THE INVENTION

The desulfurization agent of the present invention utilizes a puck or briquette of deoxidizing metal in combination with ferrous metal to form a new and effective deoxidizing and/or desulfurization agent. The metal materials that are used for the deoxidizing and/or desulfurization agent can be partially or fully formed from scrap materials; however, this is not required. When the metal materials that are used to for the deoxidizing and/or desulfurization agent are partially or fully formed from scrap materials, such scrap materials can in the form of machine chips (e.g., metal chips, turnings and the like) that are typically are mixed with various amounts of machining or cutting lubricant. It is not uncommon that the fluid content of the mixture of machine chips and cutting fluid is up to about 48 weight percent. Typically, the cutting fluid includes oil and water. The machine chips can be processed at or close to a manufacturing facility that generates the machine chips so as to reduce the amount of cutting fluid content; however, this is not required. The process for reducing the cutting fluid content can involve one or more steps. One non-limiting process involves the straining and/or centrifuging of the machine chips until the desired amount of cutting fluid has been removed. Another non-limiting process involves the compacting of the machine chips to form a puck or briquette of deoxidizing and/or desulfurization agent in accordance with the present invention. Still another non-limiting process involves an initial step of straining and/or centrifuging the machine chips to remove an initial amount of cutting and fluid, and subsequently compressing the machine chips together to further reduce the cutting fluid content to form a puck or briquette of deoxidizing and/or desulfurization agent in accordance with the present invention. One non-limiting specific process for reducing the cutting fluid content of the recycled machine chips involves first conveying the machine chips to a cyclone separator. The machine chips can be pneumatically conveyed and/or conveyed by other means. The cyclone separator initially removes cutting fluid and other liquids from the machine chips. After passing through the cyclone separator, the machine chips can be fed into a briquetter. The briquetter is used to compress the machine chips to form a round or polygonal briquette. A round briquette is commonly referred to as a puck. Two types of briquetter that can be used are manufactured by Altek International of Exton, Pa. and EMI of Cleveland, Ohio.

The density of the puck or briquette of deoxidizing and/or desulfurization agent in accordance with the present invention is high enough to prevent a majority of the pucks or briquettes from floating to the surface of the molten iron during the deoxidizing and/or desulfurization process. Typically, the average density of the puck or briquette of deoxidizing and/or desulfurization agent is slightly greater than the density of the molten iron to be deoxidized and/or desulfurize. In one non-limiting example, the average density of the puck or briquette of deoxidizing and/or desulfurization agent is at least about 6.9 g/cm$^3$. The average of the metal materials used to at least partially form puck or briquette of deoxidizing and/or desulfurization agent is generally less than about 2 inches; however, many other sizes can be used. The puck or briquette of deoxidizing and/or desulfurization agent includes at least one ferrous material and at least one deoxidizing metal. The total weight percent of the ferrous metal in the puck or briquette of deoxidizing and/or desulfurization agent is typically greater than the total weight of the at least one deoxidizing metal in the puck or briquette of deoxidizing and/or desulfurization agent. Several non-limiting examples of a deoxidizing and/or desulfurization agent that can be formed in accordance with the present invention are set forth below.

Example A

| | |
|---|---|
| Deoxidizing Metal | 0.5-70 wt % |
| Ferrous Metal | 30-99 wt % |
| Liquid | 0-10 wt % |
| Calcium Compound | 0-40 wt % |
| Average Density | 6.9-7.8 g/cm$^3$ |

Example B

| | |
|---|---|
| Deoxidizing Metal | 0.5-49 wt % |
| Ferrous Metal | 50-99 wt % |
| Liquid | 0-10 wt % |
| Calcium Compound | 0-40 wt % |
| Average Density | 6.9-7.8 g/cm$^3$ |

Example C

| | |
|---|---|
| Deoxidizing Metal | 1-30 wt % |
| Ferrous Metal | 70-99 wt % |
| Liquid | 0-5 wt % |
| Calcium Compound | 0-20 wt % |
| Average Density | 6.9-7.8 g/cm$^3$ |

Example D

| | |
|---|---|
| Deoxidizing Metal | 1-20 wt % |
| Ferrous Metal | 80-99 wt % |
| Liquid | 0-5 wt % |
| Calcium Compound | 0-10 wt % |
| Average Density | 6.9-7.6 g/cm$^3$ |

Example E

| | |
|---|---|
| Deoxidizing Metal | 5-15 wt % |
| Ferrous Metal | 85-95 wt % |
| Liquid | 0-4 wt % |
| Calcium Compound | 0-5 wt % |
| Average Density | 6.9-7.6 g/cm$^3$ |

Example F

| | |
|---|---|
| Mg Metal | 8-12 wt % |
| Ferrous Metal (CS and/or SS) | 88-92 wt % |
| Liquid (Water and/or oil) | 0.01-3 wt % |
| Calcium Compound | 0-3 wt % |
| Average Density | 6.95-7.4 g/cm$^3$ |

Example G

| | |
|---|---|
| Mg and Al Metal (20-90% Mg) | 5-15 wt % |
| Ferrous Metal (CS and/or SS) | 85-95 wt % |
| Liquid (Water and/or oil) | 0-5 wt % |
| Calcium Compound | 0-20 wt % |
| Average Density | 6.95-7.65 g/cm$^3$ |

Example H

| | |
|---|---|
| Mg and Ti Metal (20-95% Mg) | 5-25 wt % |
| Ferrous Metal (CS and/or SS) | 85-95 wt % |
| Liquid (Water and/or oil) | 0-5 wt % |
| Calcium Compound | 0-20 wt % |
| Average Density | 6.95-7.75 g/cm$^3$ |

Example I

| | |
|---|---|
| Mg and Zr Metal (20-90% Mg) | 5-35 wt % |
| Ferrous Metal (CS and/or SS) | 65-95 wt % |
| Liquid | 0-5 wt % |

-continued

| | |
|---|---|
| (Water and/or oil) | |
| Calcium Compound | 0-20 wt % |
| Average Density | 6.95-7.85 g/cm$^3$ |

Example J

| | |
|---|---|
| Al Metal | 5-18 wt % |
| Ferrous Metal (CS and/or SS) | 82-95 wt % |
| Liquid (Water and/or oil) | 0-5 wt % |
| Calcium Compound | 0-20 wt % |
| Average Density | 6.95-7.7 g/cm$^3$ |

In Examples A-J, puck or briquette of deoxidizing and/or desulfurization agent can be formed in a variety of different sizes and shapes. In one particular non-limiting arrangement, the puck or briquette of deoxidizing and/or desulfurization agent can have a generally cylindrical shape with a diameter of about 3-6 inches and a thickness of about 1-4 inches, and an average weight of about 2-10 lbs.

The composition of the puck or briquette of deoxidizing and/or desulfurization agent in Examples A-J is primary deoxidizing metal and ferrous metal. Generally the deoxidizing metal and ferrous metal constitute a majority weight percent of the puck or briquette of deoxidizing and/or desulfurization agent, and typically at least about 75 weight percent of the puck or briquette of deoxidizing and/or desulfurization agent, and more typically at least about 85 weight percent of the puck or briquette of deoxidizing and/or desulfurization agent. As can be appreciated, the deoxidizing metal and ferrous metal can constitute about 95-100 weight percent of the puck or briquette of deoxidizing and/or desulfurization agent.

The ferrous metal in Examples A-J can be any type of ferrous alloy that includes a majority weight percent iron. Typical types of ferrous metals that can be used in the puck or briquette of deoxidizing and/or desulfurization agent include, but are not limited to, carbon steel, low carbon steel, and/or stainless steel. Cast iron is generally not included in the puck or briquette of deoxidizing and/or desulfurization agent due to its lower density; however, if cast iron is used, the weight percentage of the cast iron constitutes less than a majority weight percent of the ferrous metal in the puck or briquette of deoxidizing and/or desulfurization agent. The ferrous metal in the puck or briquette of deoxidizing and/or desulfurization agent can be a single form of ferrous metal or different types of ferrous metals. A portion or all of the ferrous metal can be from scrap metal; however, this is not required.

The deoxidizing metal in Examples A-J can be a single type or multiple types of deoxidizing metals. Non-limiting examples of deoxidizing metal that can be used include aluminum, magnesium, titanium, and/or zirconium. Example F illustrates a puck or briquette of deoxidizing and/or desulfurization agent that only includes magnesium metal as the deoxidizing metal. Example J illustrates a puck or briquette of deoxidizing and/or desulfurization agent that only includes aluminum metal as the deoxidizing metal. Example G illustrates a puck or briquette of deoxidizing and/or desulfurization agent that only includes magnesium and aluminum metal as the deoxidizing metal. Example H illustrates a puck or briquette of deoxidizing and/or desulfurization agent that only includes magnesium and titanium metal as the deoxidizing metal. Example I illustrates a puck or briquette of deoxidizing and/or desulfurization agent that only includes magnesium and zirconium metal as the deoxidizing metal. The deoxidizing metal can be from reclaimed scrap metal; however, it can be appreciated that some or all of the deoxidizing metal can be from other sources (e.g., a purified source, etc.). The deoxidizing metal can be in a pure metal form and/or contained in a metal alloy. When more than one type of deoxidizing metal is used, one of the deoxidizing metals is typically magnesium; however, this is not required. In addition, when more than one type of deoxidizing metal is used, one of the deoxidizing metals is typically magnesium and magnesium constitute a majority weight percent of the deoxidizing metal; however, this is not required.

In Examples A-E and G-J, the puck or briquette of deoxidizing and/or desulfurization agent can include a liquid; however, this is not required. Example F illustrates the puck or briquette of deoxidizing and/or desulfurization agent as including some liquid. The source of liquid is generally from the water, oil and/or other lubricants, solvents, etc. that are commonly associated with scrap metals; however, it can be appreciated that other or additional types of liquids could be included in the puck or briquette of deoxidizing and/or desulfurization agent. The amount of liquid in the puck or briquette of deoxidizing and/or desulfurization agent, when used, is limited so as to achieve the desired average density of the puck or briquette of deoxidizing and/or desulfurization agent. In addition, the amount of liquid in the puck or briquette of deoxidizing and/or desulfurization agent, when used, is limited so as to maintain the integrity of the puck or briquette of deoxidizing and/or desulfurization agent.

The average density of puck or briquette of deoxidizing and/or desulfurization agent is at least 6.9 g/cm$^3$. Molten iron typically has an density of about 6.9 g/cm$^3$; however, other types of molten ferrous metal that are to be deoxidized and/or desulfurized can have a slightly higher or lower density. The average density of puck or briquette of deoxidizing and/or desulfurization agent is selected to be at least the same and typically greater that the density of molten ferrous metal that is to be deoxidized and/or desulfurized so that the puck or briquette of deoxidizing and/or desulfurization agent does not float to the surface of the molten ferrous metal that is to be deoxidized and/or desulfurized. The average porosity of the puck or briquette of deoxidizing and/or desulfurization agent is generally no greater than about 10% so as to achieve the desired average density of the puck or briquette of deoxidizing and/or desulfurization agent; however, higher may be used. Typically, the average porosity of the puck or briquette of deoxidizing and/or desulfurization agent is generally less than about 8%, more typically less than about 6%, even more typically less than about 4%, and even more typically less than about 3%.

The puck or briquette of deoxidizing and/or desulfurization agent can include one or more calcium compounds; however, this is not required. When one or more calcium compounds are included in the puck or briquette of deoxidizing and/or desulfurization agent, the calcium compound generally includes calcium oxide and/or calcium carbide. The amount of calcium compound in the puck or briquette of deoxidizing and/or desulfurization agent, when used, is limited so as to achieve the desired average density of the puck or briquette of deoxidizing and/or desulfurization agent. The minimum amount of one or more calcium compounds in the puck or briquette of deoxidizing and/or desulfurization agent, when calcium compound is used, is typically at least about 0.1 weight percent of the puck or briquette of deoxidizing and/or desulfurization agent. As can also be appreciated, the puck or briquette of deoxidizing and/or desulfurization agent can include one or more additives that can be used to facilitate in the removal of slag from the surface of the motel iron, and/or to facilitate in removing oxygen and/or sulfur from the molten iron. For example, the puck or briquette of deoxidizing and/or desulfurization agent can include one or more slag-improvement agents (e.g., metallurgical and/or acid grade fluorspar, dolomitic lime, silica, sodium carbonate, sodium chloride, potassium chloride, potash, cryolite, potassium cryolite, colemanite, calcium chloride, calcium aluminate, sodium fluoride, anhydrous borax, nepheline syenite, and/or soda ash); however, this is not required.

The puck or briquette of deoxidizing and/or desulfurization agent can be used as is when using the puck or briquette of deoxidizing and/or desulfurization agent as a deoxidizing and/or desulfurization agent for the molten steel.

Non-limiting methods for using the puck or briquette of deoxidizing and/or desulfurization agent are set forth below.

Method 1

A plurality of pucks or briquettes of deoxidizing and/or desulfurization agent are initially placed in an iron trough or ladle that essentially does not contain any molten iron. The plurality of pucks or briquettes of deoxidizing and/or desulfurization agent can be individually inserted into the iron trough or ladle and/or dumped into the iron trough or ladle. As can be appreciated, one or more bags that contain a plurality of pucks or briquettes of deoxidizing and/or desulfurization agent can be inserted into the iron trough or ladle. When one or more bags of containing a plurality of pucks or briquettes of deoxidizing and/or desulfurization agent are used, these bags are typically formed of a material that will quickly burn and that will not contaminate the molten iron (e.g., burlap bags, nylon bags, paper bags, etc.). As can be appreciated, if the iron trough or ladle is hot, the bags may begin to burn prior to the molten iron being added into the iron trough or ladle; however, this is not required to occur. It can also be appreciated that when a plurality are pucks or briquettes of deoxidizing and/or desulfurization agent and/or bags containing a plurality of pucks or briquettes of deoxidizing and/or desulfurization agent are initially placed in a hot iron trough or ladle, some or all of the liquid in the plurality of pucks or briquettes of deoxidizing and/or desulfurization agent can begin to burn off and/or vaporize prior to the molten iron being added into the iron trough or ladle; however, this is not required to occur. When a plurality are pucks or briquettes of deoxidizing and/or desulfurization agent and/or bags containing a plurality of pucks or briquettes of deoxidizing and/or desulfurization agent are initially placed in a hot iron trough or ladle, the pouring of the molten iron can be delayed by some time period (e.g., 0.1-20 minutes, etc.) to allow the bags to partially or fully burn and/or allow some or all of the liquid in the plurality of pucks or briquettes of deoxidizing and/or desulfurization agent to burn off and/or vaporize prior to the molten iron being added; however, this is not required. After the plurality of pucks or briquettes of deoxidizing and/or desulfurization agent are inserted into iron trough or ladle, the molten iron is added to the iron trough or ladle. When the molten iron contacts the plurality of pucks or briquettes of deoxidizing and/or desulfurization agent, the plurality of pucks or briquettes of deoxidizing and/or desulfurization agent begin to melt and the one or more deoxidizing metals react with the oxygen and/or sulfur in the molten iron to form a slag on the surface of the molten iron that is subsequently removed. The ferrous material in the plurality of pucks or briquettes of deoxidizing and/or desulfurization agent also melts and adds iron units to the molten iron. The molten iron can be continuously or periodically agitated or mixed to increase the rate at when the deoxidizing metal reacts with the oxygen and/or sulfur in the molten iron; however, this is not required. The use of the plurality of pucks or briquettes of deoxidizing and/or desulfurization agent can be the sole deoxidizing and/or desulfurization for the molten iron.

Method 2

This method is similar to Method 1 except that after the deoxidizing and/or desulfurizing the molten iron by the plurality of pucks or briquettes of deoxidizing and/or desulfurization agent is complete or substantially complete, the molten iron is subsequently treated with one or more additional deoxidizing and/or desulfurization processes. Such one or more additional processes can include the addition of one or more other metals and/or additives (e.g., calcium compound, deoxidizer metal, slag improvement agents, etc.) to the molten iron. Typically, the plurality of pucks or briquettes of deoxidizing and/or desulfurization agent are as the first or at least one of the earlier processes for deoxidizing and/or desulfurizing the molten iron. These one or more subsequent processes can be the same as or similar to the process set forth in the patents that are identified above and which are incorporated in their entirety herein.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

Having thus described the invention, it is claimed:

1. A method for removing oxygen, sulfur, or mixtures thereof from molten iron comprising:

(a) obtaining reclaimed ferrous scrap metal coated with oil, wherein said ferrous metal includes carbon steel, stainless steel, or mixtures thereof;

(b) obtaining reclaimed deoxidizing/desulfurizing scrap metal coated with oil, wherein said deoxidizing/desulfurizing scrap metal is magnesium metal, plus at least one metal selected from the group consisting of aluminum, titanium, and zirconium, and wherein said magnesium metal is at least 5 weight percent of said deoxidizing/desulfurizing scrap metal;

(c) combining and pressing said reclaimed ferrous scrap metal coated with oil and said reclaimed deoxidizing/desulfurizing scrap metal coated with oil to form a plurality of pucks or plurality of briquettes, wherein the pressing removes at least some of the oil coating on the ferrous scrap metal and deoxidizing/desulfurizing scrap metal, wherein the plurality of pucks or plurality of briquettes is characterized as follows:

average density of about 6.9-7.8 g/cm$^3$, average weight of at least about 2 lbs., said ferrous scrap metal is over 80 weight percent of each puck or briquette, said deoxidizing/desulfurizing scrap metal is at least about 2 weight percent of said puck or briquette, wherein a weight ratio of said ferrous scrap metal to said deoxidizing/desulfurizing scrap metal is about 6-20:1, and said oil is 0.01 to about 5 weight percent of each puck or briquette;

(b) placing said plurality of pucks or briquettes into an iron trough or ladle;

(c) pouring molten iron into said iron trough or ladle after said plurality of pucks or briquettes were placed into an iron trough or ladle, such that said plurality of pucks or briquettes do not float to the surface of said molten iron after said molten iron is poured into said iron trough or ladle, wherein the oil of said plurality of pucks or briquettes volatilizes on contact with the molten iron, and produces a gas that enhances the reaction between the deoxidizing/desulfurizing scrap metal and the sulfur in the molten iron by at least partially mixing the deoxidizing/desulfurizing scrap metal throughout the molten iron.

2. The method as defined in claim 1, further including delaying said step of pouring molten iron into said iron trough or ladle after said bag with said plurality of pucks or briquettes are inserted into said iron trough or ladle by at least 0.1 minutes, so a) said bag burns prior to said molten iron being added to said iron trough or ladle and b) said oil in said plurality of pucks or briquettes burns or vaporizes prior to said molten iron being added to iron trough or ladle, or combinations thereof.

3. The method as defined in claim 1, further including the step of adding additional desulfurization agents to said molten iron after said molten iron is added to said iron trough or ladle and after desulfurization by said plurality of pucks or briquettes is complete or substantially complete.

4. The method as defined in claim 2, further including the step of adding additional desulfurization agents to said molten iron after said molten iron is added to said iron trough or ladle and after desulfurization by said plurality of pucks or briquettes is complete or substantially complete.

5. The method as defined in claim 1, wherein magnesium metal constituting over 50 weight percent of said deoxidizing/desulfurizing scrap metal.

6. The method as defined in claim 4, wherein magnesium metal constituting over 50 weight percent of said deoxidizing/desulfurizing scrap metal.

7. The method as defined in claim 1, wherein said plurality of pucks or briquettes includes a calcium compound in an amount of from about 0.5 to 10 weight percent.

8. The method as defined in claim 6, wherein said plurality of pucks or briquettes includes a calcium compound in an amount of from about 0.5 to 10 weight percent.

9. The method as defined in claim 7, wherein said calcium compound in said plurality of pucks or briquettes has an average particle size of 18-100 US Mesh.

10. The method as defined in claim 8, wherein said calcium compound in said plurality of pucks or briquettes has an average particle size of 18-100 US Mesh.

11. The method as defined in claim 1, wherein said plurality of pucks or briquettes include by weight percent of said puck or briquette:

| | |
|---|---|
| Mg Metal plus Al Metal: (20-90% Mg Metal) | 5-15 wt % |
| Carbon steel and/or stainless steel | 85-95 wt % |
| Water and/or oil | 0.1-5 wt % |
| Calcium Compound | up to 20 wt % |
| Average Density | 6.95-7.65 g/cm$^3$. |

12. The method as defined in claim 10, wherein said plurality of pucks or briquettes include by weight percent of said puck or briquette:

| | |
|---|---|
| Mg Metal plus Al Metal: (20-90% Mg Metal) | 5-15 wt % |
| Carbon steel and/or stainless steel | 85-95 wt % |
| Water and/or oil | 0.1-5 wt % |
| Calcium Compound | up to 20 wt % |
| Average Density | 6.95-7.65 g/cm$^3$. |

13. The method as defined in claim 1, wherein said plurality of pucks or briquettes include by weight percent of said puck or briquette:

| | |
|---|---|
| Mg Metal and Ti Metal: (20-95% Mg Metal) | 5-25 wt % |
| Carbon steel and/or stainless steel | 85-95 wt % |
| Water and/or oil | 0.1-5 wt % |
| Calcium Compound | up to 20 wt % |
| Average Density | 6.95-7.75 g/cm$^3$. |

14. The method as defined in claim 10, wherein said plurality of pucks or briquettes include by weight percent of said puck or briquette:

| | |
|---|---|
| Mg Metal and Ti Metal: (20-95% Mg Metal) | 5-25 wt % |
| Carbon steel and/or stainless steel | 85-95 wt % |
| Water and/or oil | 0.1-5 wt % |
| Calcium Compound | up to 20 wt % |
| Average Density | 6.95-7.75 g/cm$^3$. |

15. The method as defined in claim 1, wherein said plurality of pucks or briquettes include by weight percent of said puck or briquette:

| | |
|---|---|
| Mg Metal and Zr Metal: (20-90% Mg) | 5-35 wt % |
| Carbon steel and/or stainless steel | 65-95 wt % |
| Water and/or oil | 0.1-5 wt % |
| Calcium Compound | up to 20 wt % |
| Average Density | 6.95-7.85 g/cm$^3$. |

16. The method as defined in claim 10, wherein said plurality of pucks or briquettes include by weight percent of said puck or briquette:

| | |
|---|---|
| Mg Metal and Zr Metal: (20-90% Mg) | 5-35 wt % |
| Carbon steel and/or stainless steel | 65-95 wt % |
| Water and/or oil | 0.1-5 wt % |
| Calcium Compound | up to 20 wt % |
| Average Density | 6.95-7.85 g/cm$^3$. |

* * * * *